US011207690B2

(12) United States Patent
Brutinel et al.

(10) Patent No.: US 11,207,690 B2
(45) Date of Patent: Dec. 28, 2021

(54) STEM-WELL FILMS FOR SAMPLE PARTITIONING

(71) Applicant: 3M INNOVATIVE PROPERTIES COMPANY, St. Paul, MN (US)

(72) Inventors: Evan D. Brutinel, Inver Grove Heights, MN (US); Joseph D. Rule, Woodbury, MN (US); Jonathan E. Janoski, Woodbury, MN (US); Anthony F. Schultz, Forest Lake, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 205 days.

(21) Appl. No.: 16/064,064

(22) PCT Filed: Dec. 19, 2016

(86) PCT No.: PCT/US2016/067437
§ 371 (c)(1),
(2) Date: Jun. 20, 2018

(87) PCT Pub. No.: WO2017/112564
PCT Pub. Date: Jun. 29, 2017

(65) Prior Publication Data

US 2019/0001326 A1 Jan. 3, 2019

Related U.S. Application Data

(60) Provisional application No. 62/270,757, filed on Dec. 22, 2015.

(51) Int. Cl.
*B01L 3/00* (2006.01)

(52) U.S. Cl.
CPC ..... *B01L 3/50853* (2013.01); *B01L 2300/041* (2013.01); *B01L 2300/044* (2013.01);
(Continued)

(58) Field of Classification Search
CPC . B01L 3/5085; B01L 9/523; B01L 2300/0829
See application file for complete search history.

(56) References Cited

U.S. PATENT DOCUMENTS 4,678,695 A 7/1987 Tung
5,077,870 A 1/1992 Melbye
(Continued)

FOREIGN PATENT DOCUMENTS

JP 2003-107094 A 4/2003
JP 2003107094 A * 4/2003
(Continued)

OTHER PUBLICATIONS

English translation of JP-2003107094-A. (Year: 2003).*
(Continued)

*Primary Examiner* — Matthew D Krcha
(74) *Attorney, Agent, or Firm* — Yufeng Dong

(57) ABSTRACT

Sample partitioning devices and methods of making and using the same are described. A sample partitioning device includes a first film having an array of discrete stems each extending from a first major surface thereof, and a second film having an array of discrete wells formed into a second major surface thereof. The stems of the first film and the wells of the second film are mated with each other. The mated stems and wells are separable from each other, and during the removal of the stems from the wells, one or more voids are created inside the wells to suction an aqueous test sample into the wells.

18 Claims, 2 Drawing Sheets

(52) U.S. Cl.
CPC . *B01L 2300/0896* (2013.01); *B01L 2300/123* (2013.01); *B01L 2300/161* (2013.01)

(56) References Cited

U.S. PATENT DOCUMENTS

| | | | | |
|---|---|---|---|---|
| 5,461,134 | A | 10/1995 | Leir | |
| 5,474,827 | A | 12/1995 | Crandall | |
| 5,620,895 | A | 4/1997 | Naqui | |
| 5,812,317 | A | 9/1998 | Billingsley | |
| 5,824,390 | A | 10/1998 | Ochi | |
| 5,962,251 | A | 10/1999 | Rambach | |
| 6,007,914 | A | 12/1999 | Joseph | |
| 6,063,579 | A * | 5/2000 | Bevirt | B01L 3/5085 422/502 |
| 6,172,810 | B1 | 1/2001 | Fleming | |
| 6,355,302 | B1 | 3/2002 | Vandenberg | |
| 6,391,578 | B2 | 5/2002 | Williams | |
| 6,458,533 | B1 | 10/2002 | Felder | |
| 6,627,159 | B1 | 9/2003 | Bedingham | |
| 6,696,286 | B1 | 2/2004 | Halverson | |
| 7,582,472 | B2 | 9/2009 | Smith | |
| 7,723,452 | B2 | 5/2010 | Hooftman | |
| 8,632,996 | B2 | 1/2014 | Shitara | |
| 2002/0009392 | A1 * | 1/2002 | Wolk | B01L 3/502715 422/63 |
| 2003/0077440 | A1 | 4/2003 | Razavi | |
| 2004/0022677 | A1 * | 2/2004 | Wohlstadter | B01L 9/50 422/52 |
| 2004/0142479 | A1 | 7/2004 | Moerman | |
| 2008/0293127 | A1 * | 11/2008 | Chiang | C09J 5/00 435/283.1 |
| 2010/0137163 | A1 | 6/2010 | Link | |
| 2011/0250597 | A1 | 10/2011 | Larson | |
| 2011/0263461 | A1 | 10/2011 | Kastury | |
| 2014/0311706 | A1 * | 10/2014 | Tenzler | B01L 7/52 165/61 |
| 2015/0087078 | A1 * | 3/2015 | Richardson | B01L 3/50853 436/180 |

FOREIGN PATENT DOCUMENTS

| | | |
|---|---|---|
| WO | WO 2011-063332 | 5/2011 |
| WO | WO 2013-063230 | 5/2013 |
| WO | WO 2016-094277 | 6/2016 |

OTHER PUBLICATIONS

Moerman, "A coverslip method for controlled parallel sample introduction into arrays of (Sub)nanoliter wells for quantitative analysis", Anal. Chem, 2003, vol. 75, pp. 4132-4138.

Jackman, "Fabricating large arrays of microwells with arbitrary dimensions and filling them using discontinuous dewetting", Anal. Chem., 1998, vol. 70, pp. 2280-2287.

International Search report for PCT International Application No. PCT/US2016/067437 dated May 19, 2017, 6 pages.

* cited by examiner

STEM-WELL FILMS FOR SAMPLE PARTITIONING

CROSS REFERENCE TO RELATED APPLICATIONS

This application is a national stage filing under 35 U.S.C. 371 of PCT/US2016/067437, filed Dec. 19, 2016, which claims the benefit of U.S. Application No. 62/270,757, filed Dec. 22, 2015, the disclosure of which is incorporated by reference in its/their entirety herein.

TECHNICAL FIELD

This disclosure relates to sample partitioning devices including separably mated stem-well films, and to methods of making and using the same.

BACKGROUND

A wide variety of methods and devices have been developed for segmenting an aqueous test sample into a large number of smaller discrete volumes. By using a sample partitioning device, a series of tiny compartments can be filled with the aqueous test sample where desired reaction or growth can occur and be detected much more rapidly than the same reaction or growth in a larger volume. A number of techniques have been disclosed such as, for example, the techniques described in U.S. Pat. No. 4,678,695 (Tung et al.), U.S. Pat. No. 5,824,390 (Ochi et al.), U.S. Pat. No. 5,474,827 (Crandall et al.), U.S. Pat. No. 5,812,317 (Billingsley et al.), U.S. Pat. No. 7,723,452 (Hooftman et al.), U.S. Pat. No. 6,172,810 (Fleming et al.), U.S. Pat. No. 6,355,302 (Vandenberg et al.), etc.

SUMMARY

Described herein are sample partitioning devices, and methods of making and using them. Briefly, in one aspect, the present disclosure describes a sample partitioning device which includes a first film including an array of discrete stems each extending from a first major surface thereof, and a second film including an array of discrete wells formed into a second major surface thereof. The stems of the first film and the wells of the second film are mated with each other. The mated stems and wells are separable from each other, and during the removal of the stems from the wells, one or more voids are created inside the wells that are capable of suctioning an aqueous test sample into the wells.

In another aspect, the present disclosure describes a sample partitioning device that includes a film having an array of discrete wells formed into a major surface thereof. The array of wells has a density between 100 and 10,000 wells/inch$^2$ (wpi), and the wells have an average volume of 1 to 500 nanoliters. The wells are Tillable to greater than 95% of their volume with an aqueous solution. A cover film is laminated over the major surface of the film to cover the wells to provide a vapor impermeable seal over each of the wells.

In yet another aspect, the present disclosure describes a method including providing a first film comprising an array of discrete stems each extending away from a first major surface thereof, and providing a second film comprising an array of wells that are mated with the stems of the first film. The mated stems and wells are submerged in an aqueous test sample. The first film is then separated from the second film to remove the stems from the wells. During the removal of the stems, one or more voids are created inside the wells to suction the aqueous test sample into the wells and fill the wells.

In yet another aspect, the present disclosure describes a method of producing a sample partitioning device. The method includes providing a first film comprising an array of discrete stems each extending away from a first major surface thereof. A polymeric composition is provided on the first major surface of the first film. The polymeric composition is cured to form a continuous second film including an array of discrete wells corresponding to the stems in negative relief. The stems and wells are separably mated where an outer surface and an inner surface thereof are in direct physical contact.

BRIEF DESCRIPTION OF THE DRAWINGS

The present application may be more completely understood in consideration of the following detailed description of various embodiments of the disclosure in connection with the accompanying drawings.

In the following description of the illustrated embodiments, reference is made to the accompanying drawings, in which is shown by way of illustration, various embodiments in which the disclosure may be practiced. It is to be understood that the embodiments may be utilized and structural changes may be made without departing from the scope of the present disclosure. The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Sample partitioning devices, and methods of making and using the articles are described herein. The present disclosure describes sample partitioning devices which include a first film, e.g., a stem film including an array of discrete stems each extending from a first major surface thereof, and a second film, e.g., a well film including an array of discrete wells formed into a second major surface thereof. The stems of the stem film and the wells of the well film are separably mated with each other. In some cases, when the mated stems and wells are submerged in a quantity of aqueous solution, during the removal of the stems from the wells, one or more voids are created inside the wells to suction the aqueous solution into the wells.

Figure 1A:
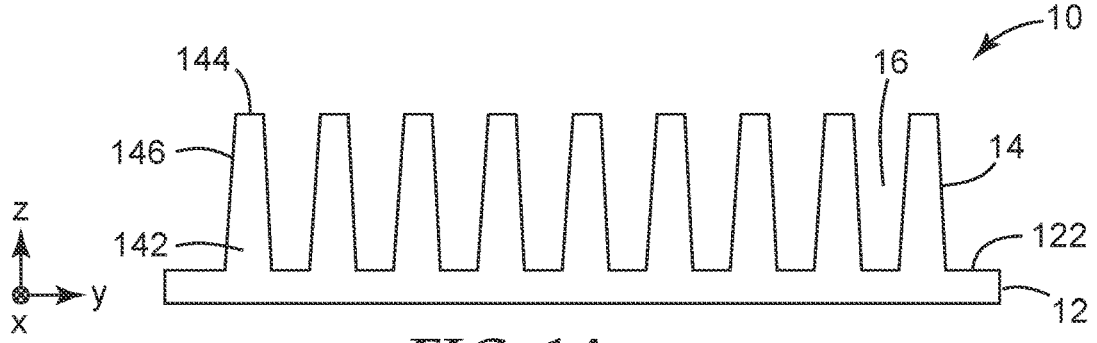
FIG. 1A illustrates a cross-sectional view of a stem film including an array of stems, according to one embodiment.

FIG. 1A illustrates a cross-sectional view of a stem film 10, according to one embodiment. The stem film 10 includes a base 12 and an array of discrete posts or stems 14 integral with the base 12. Each posts 14 extend away from a major surface 122 thereof and extend between a first end 142 and a second end 144 thereof. The first ends 142 are connected to the base 12. The posts 14 and the base 12 may be made of the same material or different materials and integral as one piece.

In the embodiment illustrated in FIG. 1A, the posts 14 each have a conical shape that is generally circular in cross section. It is to be understood that the posts 14 may have various cross sectional shapes such as, for example, a circular shape, an oval shape, a square shape, a polygon shape such as a hexagon, etc. The posts 14 are slightly tapered to a smaller cross sectional area adjacent the second end 144 than at the first end 142. A draft angle is the included angle between the side surfaces 146 and the z-axis of the posts 14. The draft angle within an appropriate range may help facilitate removal of the posts from cavities such as in a molding process of producing the stem film 10. The draft angle may also affect the separation of the posts 14 and wells mated with the posts 14, and thus affect the suction of liquid into the wells when separating the mated posts and wells, which will be discussed further below. In some embodiments, the draft angle may be, for example, no greater than 30°, no greater than 15°, no greater than 10°, or greater than 8°, or no greater than 5°. In some embodiments, the draft angle can be, for example, no less than 0.5, no less than 1°, no less than 2°, or no less than 3°. In some embodiments, a useful range of the draft angle may be between 1° and 10°. It is understood that the shape of the posts may not be symmetrical, and thus may have more than one draft angle depending upon from which side of the post it is measured. In some embodiments it may even be advantageous to provide a draft angle that is greater on one side of the post (and well) to facilitate increased ease of removing the stem film from the well film in a particular preselected direction.

The posts 14 have a height "H" which is a longitudinal distance between the first end 142 and the send end 144 of the respective posts 14. The first and second ends 142 and 144 have a first end width "W1" and a second end width "W2", respectively. The first width "W1" and the second end width "W2" are representative lateral dimensions of the cross sections of the posts 14 in the respective lateral planes. The posts 14 each have a tapered shape so that W1 is greater than the corresponding W2. The height "H" of the posts 14 can be, for example, no less than 10 microns, no less than 20 microns, no less than 50 microns, or no less than 100 microns. The height of the posts 14 can be, for example, no greater than 2 mm, no greater than 1 mm, no greater than 800 microns, or no greater than 500 microns. The average end width (W1+W2)/2 can be, for example, no less than 5 microns, no less than 10 microns, no less than 20 microns, or no less than 50 microns. The average end width (W1+W2)/2 can be, for example, no greater than 1 mm, no greater than 500 microns, no greater than 300 microns, or no greater than 200 microns.

An aspect ratio of the posts 14 can be defined as a ratio between an average longitudinal dimension (e.g., along the direction generally perpendicular to the film 10) and an average lateral dimension (e.g., along a lateral, in plane direction generally parallel to the film 10). The posts 14 have an aspect ratio that can be defined by H/((W1+W2)/2). The aspect ratio of the posts 14 may also affect the separation of the posts 14 from wells mated with the posts 14, and thus affect the suction of liquid into the wells when separating the mated posts and wells, which will be discussed further below. In some embodiments, the aspect ratio H/((W1+W2)/2) can be, for example, 0.5 or more, 1 or more, or 2 or more. In some embodiments, the aspect ratio H/((W1+W2)/2) can be, for example, 10 or less, 8 or less, or 6 or less. In some embodiments, the aspect ratio H/((W1+W2)/2) can be between 0.5 and 6.

The array of posts 14 are arranged in two dimensions with columns and rows on the base 12. The posts 14 are discrete and separated with each other by continuous cavities 16 therebetween. A pin density of the posts 14 is defined as the number of posts per area on the base 12. In some embodiments, the pin density can be 50 pins/inch$^2$ (ppi) or more, 100 ppi or more, 500 ppi or more, or 1000 ppi or more. The pin density can be 20,000 ppi or less, 10,000 ppi or less, 5000 ppi or less, or 3000 ppi or less. In some embodiments, the pin density can be between 100 and 10,000 ppi.

In some embodiments, the stem film 10 including the stems or posts 14 can be prepared by molding and curing a polymerizable resin. In some embodiments, the polymerizable resin may include, for example, olefin polymer including polypropylene, polyethylene and copolymers, silicone polymer, polyurethane, polyvinyl chloride, ethylene-vinyl acetate polymer, (meth)acrylic polymer, polyamide, polyester, poly(styrene-acrylonitrile), poly(acrylonitrile-butadiene-styrene), etc. In some embodiments, the polymerizable resin can include, for example, a combination of first and second polymerizable components selected from, for example, (meth)acrylate monomers, (meth)acrylate oligomers, and mixtures thereof. As used herein, "monomer" or "oligomer" is any substance that can be converted into a polymer. The term "(meth)acrylate" refers to both acrylate and methacrylate compounds. In some cases, the polymerizable composition can include a (meth)acrylated urethane oligomer, (meth)acrylated epoxy oligomer, (meth)acrylated polyester oligomer, a (meth)acrylated phenolic oligomer, a (meth)acrylated acrylic oligomer, and mixtures thereof. The polymerizable resin can be a radiation curable polymeric resin, such as an ultraviolet (UV) curable resin. It is to be understood that the stem film 10 can be formed by any suitable processes including, for example, injection, molding, hot embossing, UV embossing, roll-to-roll embossing, etc.

In some embodiments, the posts 14 each may have a molecular orientation as evidenced by a birefringence value of at least 0.001. Such molecular orientation may provide the posts 14 with significantly greater stiffness and durability, as well as greater tensile and flexural strength, than would be achievable without such orientation. An exemplary molding process of making posts or stems having a molecular orientation is described in U.S. Pat. No. 5,077,870 (Melbye et al.), which is incorporated by reference herein.

Figure 1B:
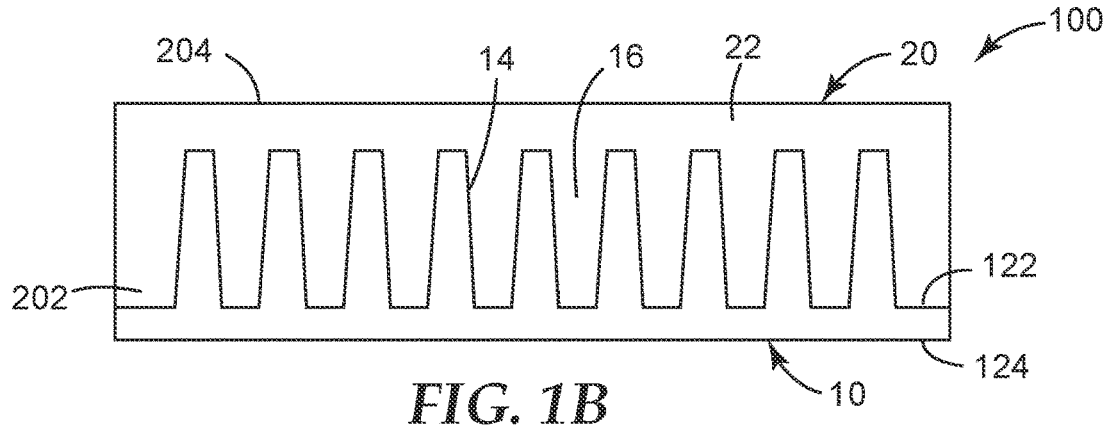
FIG. 1B illustrates a cross-sectional view of a sample partitioning device including the stem film of FIG. 1A and a well film formed thereon to mate with the stem film, according to one embodiment.

FIG. 1B illustrates a cross-sectional view of a sample partitioning device 100 including the stem film 10 of FIG. 1A and a well film 20 formed thereon, according to one embodiment. A film forming material 22 is applied onto the major surface 122 of the stem film 10. The film forming material 22 fills the cavities 16 between the posts 14 to form a continuous well film 20. The well film 20 may have a thickness of, for example, from several microns to several centimeters, from about 2 microns to about 5 mm, or from 10 microns to about 2 mm. In some embodiments, the film forming material 22 may include one or more curable polymeric materials such as, for example, (meth)acrylic polymer, polyvinyl acetal resin, polyvinylchloride, polyurethane, silicone polymer, styrenic polymer, vinyl ether polymer, vinylpyrrolidone polymer, polyester including lactone-based polymer, cyclic ether-based polymer including epoxy resins, ring-opening metathesis polymer, etc. The film forming material 22 can be cured by, for example, radiation or heating, to form a radiation cured polymeric film or a thermally cured polymeric film. It is to be understood that in some embodiments, the curable film forming material 22 may be cured at temperatures that are low enough to avoid causing possible damage to the stem film 10. In this regard, to be compatible with certain stem films that may not sustain high curing temperatures, it may be preferable to exclude certain thermoplastic resins to be used as film forming material which need high temperature and/or pressure to process, including for example, polypropylene, polyethylene, polyamides (such as nylon 6 and nylon 6,6), polyesters (such as polyethylene terephthalate, polybutylene terephthalate, or elastomers commercially available under the trade designation HYTREL), polytetrafluoroethylene, polyacetal (such as the polymer commercially available under the trade designation DELRIN), acrylonitrile-butadiene-styrene (ABS) copolymers, polyvinylchloride, polycarbonate, thermoplastic polyurethanes, and some thermoplastic acrylic polymers such as poly(methyl methacrylate) as well as blends and copolymers thereof.

The formed sample partitioning device 100 includes the mated stem and well films 10 and 20. The well film 20 has a first major surface 202 that conforms with the major surface 122 of the stem film 10. The array of posts 14 of the stem film 10 projects into the first major surface 202 of the well film 20 and is completely encapsulated by the material of the well film 20. When the first and second films 10 and 20 are separated, an array of wells can be instantaneously formed on the major surface 202 of the well film 20 that can be filled with an aqueous test sample solution to be partitioned, for example, when the first and second films 10 and 20 are separated while submerged under an amount of the aqueous solution. The formed wells correspond to the posts 14 in negative relief. In some embodiments, the posts 14 may substantially fill the well. For example, about 90% or more, about 95% or more, about 98% or more, or about 99.9% or more space of a well may be filled by the respective post 14. In some embodiments, the well may be completely filled by the post 14 with no air (e.g., less than 0.1%, less than 0.05%, or less than 0.01% of the well space) trapped therein. A well density of the wells is defined as the number of wells per area, corresponding to the pin density of the posts. In some embodiments, the well density can be 50 wells/inch$^2$ (wpi) or more, 100 wpi or more, 500 wpi or more, or 1000 wpi or more. The well density can be 20,000 wpi or less, 10,000 wpi or less, 5000 wpi or less, or 3000 wpi or less. In some embodiments, the pin density can be between 100 wpi and 10,000 wpi.

Upon the formation of the well film 20 on the stem film 10, the posts 14 and the wells are separably mated where the outer surface (e.g., the side surface 146 and the second end 144 shown in FIG. 1A) of the posts 14 is in direct, intimate physical contact with an inner surface of the wells. In some embodiments, the well film 20 may be formed on the stem film 10 by a replication process where the geometry of the first major surface 122 of the stem film 10 is transferred to the major surface 202 of the well film 20 to form the directly mated posts and wells. The film forming material 22 may be brought into a viscous or fluid state before it is brought into contact with the first major surface 122 of the stem film 10. During the period of contact between the film forming material 22 and the stem film 10, pressure, temperature or other relevant process parameters may be controlled in such a way that the film forming material 22 copies the geometry and somehow subsequently gains mechanical strength (e.g. by solidification, polymerization, etc.). In some embodiments, the viscous or fluid state of the film forming material 22 can expel air from the contacting surface with the stem film 10, thereby providing the direct, intimate physical contact between the major surface 122 of the stem film 10 and the major surface 202 of the formed well film without trapping a significant amount of air therebetween.

The mated stem film 10 and well film 20 are separable by, for example, peeling. It is to be understood that the pairing of materials for the stem film and the well film need to be compatible with each other. One useful pairing of materials include a polypropylene stem web with photo-cured acrylate-based well film. It was found in the disclosure that polyethylene and polyurethane materials may be incompatible with some UV-cured acrylate polymers where posts may become fused to the wells and it may be difficult to separate the mated posts and wells.

The sample partitioning device 100 may include optional layer(s) laminated onto the back surface 124 of the stem film 10 or the back surface 204 of the well film 20. In some embodiments, a double coated tape or transfer adhesive layer can be laminated onto the back surface 124 or 204. In some embodiments, the back surface 124 or 204 can be attached to a support such as, for example, the bottom of a dish, by a double coated tape or a transfer adhesive layer. In some embodiments, one or more tabs can be attached to the stem film 10 for manually handling the stem film 10, for example, when manually removing the stem film 10 from the well film 20 by applying a separation force at a peripheral edge of the stem film 10 and peeling the stem film away from the well film 20. The tab can be attached to the peripheral edge of the stem film 10 and have suitable shapes for handling.

In some embodiments, the sample partitioning devices may be produced in the form of a continuous web by a roll-to-roll process. Additional layers such as, for example, transfer adhesive layer, liner layer, and tabs for manual handling, etc., may be laminated or connected to the surfaces of the devices. The web may be wound into a roll, and can be cut into pieces before using.

Figure 2A:
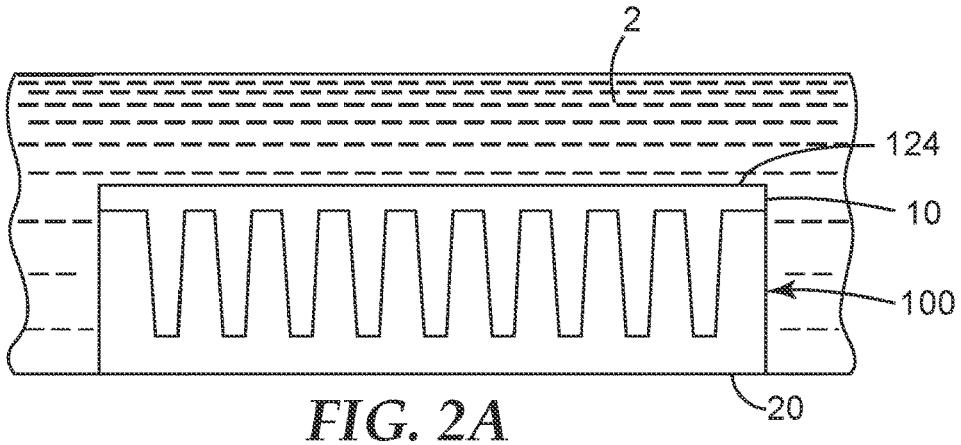
FIG. 2A illustrates the sample partitioning device of FIG. 1B submerged in an aqueous test sample solution, according to one embodiment.
Figure 2B:
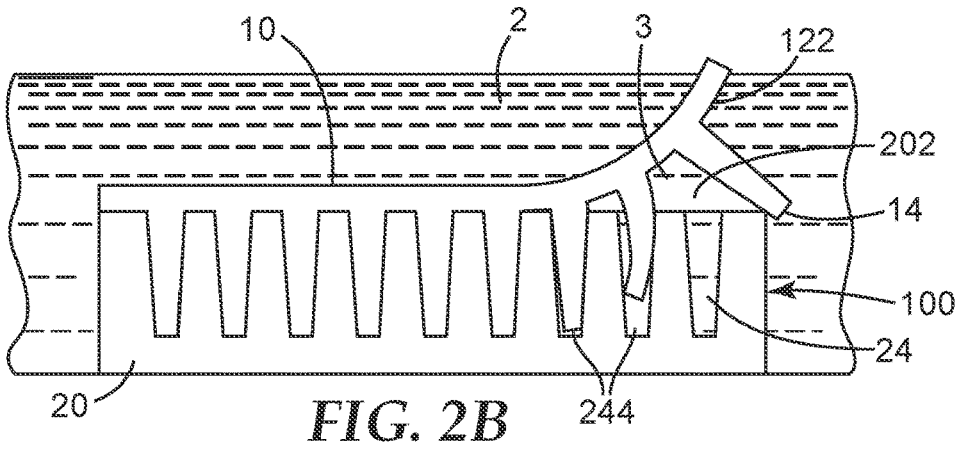
FIG. 2B illustrates the separation of the stem film from the well film to fill the wells with the aqueous test sample solution, according to the embodiment of FIG. 2A.
Figure 2C:
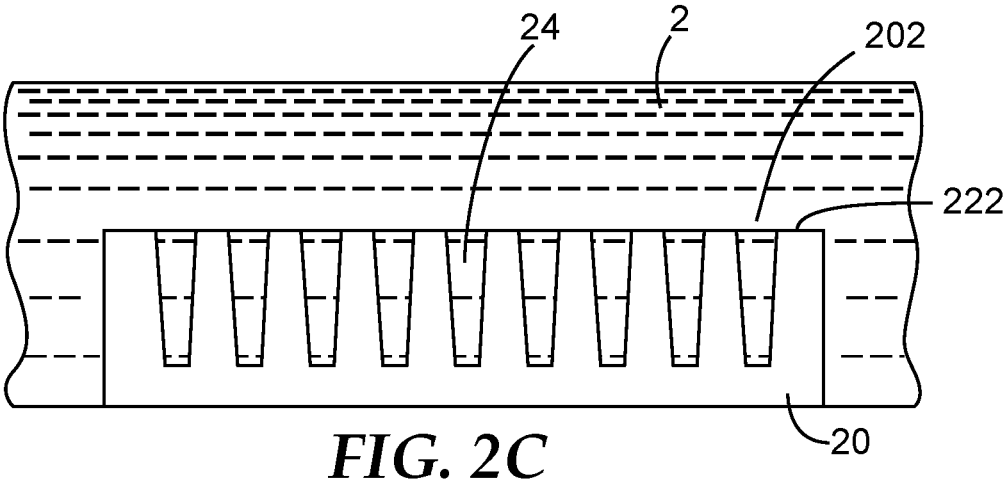
FIG. 2C illustrates the well film of FIG. 2A including an array of discrete wells filled with the aqueous test sample solution after the removal of the stem film.

FIGS. 2A-C illustrate how to use the sample partitioning device 100 of FIG. 1B to partition an aqueous test sample solution 2, according to one embodiment. The sample partitioning device 100 is submerged into the aqueous test sample 2, as shown in FIG. 2A. The stem film 10 is then removed from the well film 20 to separate the mated surfaces 122 and 202, and the mated posts 14 and wells 24. As shown in FIG. 2B, the stem film 10 is peeled away from the well film 20. During the peeling, the originally contacted surfaces 122 and 202 are separated to provide a space 3 therebetween to allow the aqueous test sample to flow into the space. During the separation of pairings of mated posts 14 and wells 24, one or more voids 244 can be instantaneously created inside the wells 24 to suction the aqueous test sample from the adjacent space 3 between the surfaces 122 and 202 into the wells 24. When the posts 14 are completely removed from the respective wells 24, the wells 24 are filled with the aqueous test sample 2, without the entrapment of air bubbles. After the removal of the stem film 10, the major surface 202 and the wells 24 filled with liquid sample can be revealed.

The separation of the mated posts 14 and wells 24, and thus the filling of the wells 24 with the aqueous test sample solution may be adjusted by considering technical aspects including, for example, geometry factors of the posts 14, the pin density of the posts 14 (or the well density of the wells 24), material properties of the posts 14 and wells 24, etc. While not wishing to be bound by theory, it is believed that (i) when the aspect ratio of the posts 14 increases, (ii) when the pin density of the posts 14 increases, or (iii) when the draft degree of the posts 14 decreases, a higher peeling force may be required to peel the stem film 10 away from the mated well film 20. Also, it is to be understood that the stem film 10 including the posts 14 has sufficient flexibility and tenacity to prevent breaking during the removal from the wells 24.

As shown in FIG. 2C, the aqueous test sample 2 is partitioned into the array of wells 24. The well film 20 submerged in the aqueous test sample 2 can then be removed therefrom by, for example, decanting or aspiration. In the depicted embodiments, the wells 24 are discrete and separated with each other by surrounding walls 222. It is to be understood that in some embodiments, adjacent wells may be selectively formed in fluid communication via, for example, fluid channels formed on the top surface of the surrounding walls 222. In some embodiments, the top surface of the surrounding walls 222 may be hydrophobic which can help partition liquid into adjacent wells 24 and/or prevent possible crosstalk between adjacent wells.

While the portioning process shown in FIGS. 2A-C is conducted by submerging the sample partitioning device 100 in an aqueous test sample, it is to be understood that the aqueous test sample may be provided in various ways. For example, in some embodiments, an aqueous solution can be provided by ejecting into the space 3 between the major surface 122 of the stem film 10 and the surface 202 of the well film 20 during the separation of the films 10 and 20, and the aqueous test sample can be suctioned into adjacent wells from the space 3.

Figure 3:
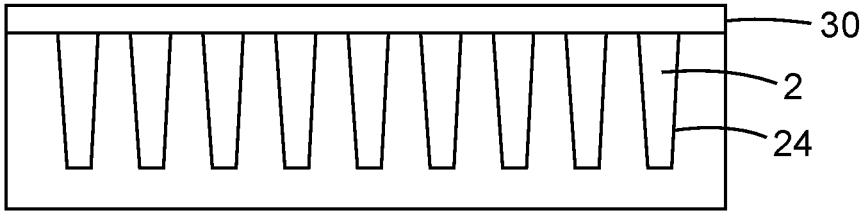
FIG. 3 illustrates the filled well film of FIG. 2C laminated with a cover film, according to one embodiment.

After the aqueous solution 2 is partitioned into the array of wells 24, the wells 24 of the well film 20 can be sealed with a cover layer 30. As shown in FIG. 3, the cover layer 30 is laminated over the wells 24 to prevent possible crosstalk and evaporation. In some embodiments, the cover layer 30 can be laminated after an excess sample is aspirated away. In some embodiments, the cover layer 30 may include, for example, a pressure-sensitive adhesive (PSA) sheet that may include a support and a PSA layer. In some embodiments, the PSA layer may be laminated with a release liner which can be removed from the PSA sheet before use.

The sample partitioning devices described herein such as the sample partitioning device 100 of FIG. 1B may be treated before use. In some embodiments, the sample partitioning device may be treated with gamma irradiation (e.g., 50 kgy) for sterilization.

The sample partitioning devices of this disclosure can be used for a variety of applications such as in molecular biology and microbiology. Various unexpected results and advantages are obtained in exemplary embodiments of the disclosure. One such advantage of exemplary embodiments of the present disclosure is that an aqueous sample solution can be partitioned into wells or compartments of a well film where the geometry, size and shape, and volume of the compartments can be customized by controlling the geometry of the corresponding posts or stems of a stem film on which the well film is formed.

Various embodiments are provided that are sample partitioning articles, methods of making the sample partitioning articles, and methods of using the sample partitioning articles. It is to be understood that any of embodiments 1-30, any one of embodiments 31-41, and any one of embodiments 42-51 may be combined.

Embodiment 1 is a sample partitioning device, comprising:

a first film comprising an array of discrete stems each extending from a first major surface thereof; and a second film comprising an array of discrete wells formed into a second major surface thereof, the stems of the first film and the wells of the second film being mated with each other, wherein the mated stems and wells are separable from each other, and during the removal of the stems from the wells, one or more voids are created inside the wells to suction an aqueous test sample into the wells.

Embodiment 2 is the device of embodiment 1, wherein at least one of the stems completely fills the respective well with an outer surface of the stem being in direct physical contact with an inner surface of the well.

Embodiment 3 is the device of embodiment 1 or 2, wherein the first major surface of the first film and the second major surface of the second film are in direct contact with each other, and the first and second major surfaces are separable from each other to provide a space therebetween allowing the aqueous test sample to flow.

Embodiment 4 is the device of any one of embodiments 1-3, wherein at least one of the stems has a shape of conical post that is tapered away from the first major surface with a draft angle between 1 and 30 degrees.

Embodiment 5 is the device of any one of embodiments 1-4, wherein the stems have an average aspect ratio between 1:2 and 6:1.

Embodiment 6 is the device of any one of embodiments 1-5, wherein the second major surface of the second film is hydrophobic.

Embodiment 7 is the device of any one of embodiments 1-6, wherein the wells have an average volume of 1 to 500 nanoliters.

Embodiment 8 is the device of any one of embodiments 1-7, wherein the array of stems has a pin density between 100 and 10,000 pins/inch (ppi).

Embodiment 9 is the device of any one of embodiments 1-8, wherein the first film comprises one or more of olefin polymer including polypropylene, polyethylene and copolymer, silicone polymer, polyurethane, polyvinyl chloride, ethylene-vinyl acetate polymer, (meth)acrylic polymer, polyamide, polyester, poly(styrene-acrylonitrile), and poly (acrylonitrile-butadiene-styrene).

Embodiment 10 is the device of any one of embodiments 1-9, wherein the second film comprises one or more of (meth)acrylic polymer, polyvinyl acetal resin, polyvinylchloride, polyurethane, silicone polymer, styrenic polymer, vinyl ether polymer, vinylpyrrolidone polymer, polyester including lactone-based polymer, cyclic ether-based polymer including epoxy resin, and ring-opening metathesis polymer.

Embodiment 11 is the device of any one of embodiments 1-10, wherein at least one of the first and second films comprises polydimethylsiloxane (PDMS).

Embodiment 12 is the device of any one of embodiments 1-11, wherein at least one of the first and second films comprises a cured acrylate polymer.

Embodiment 13 is the device of any one of embodiments 1-12, further comprising an adhesive layer attached to a surface of the second film opposite the second major surface thereof.

Embodiment 14 is the device of any one of embodiments 1-13, further comprising a tab attached to the first film.

Embodiment 15 is the device of any one of embodiments 1-14, further comprising a cover film that is configured to laminate over the wells on the second major surface of the second film after the wells are filled with the aqueous test sample.

Embodiment 16 is an article comprising:

a disposable portion comprising an array of discrete posts each extending from a first major surface thereof; and a compartment portion comprising an array of discrete wells formed into a second major surface thereof, the posts of the disposable portion each being separably mated with the respective wells of the compartment portion.

Embodiment 17 is the article of embodiment 16, wherein at least one of the posts completely fills the respective well with an outer surface of the stem being in direct physical contact with an inner surface of the well.

Embodiment 18 is the article of embodiment 16 or 17, wherein the first major surface of the disposable portion and the second major surface of the compartment portion are in direct physical contact with each other, and the first and second major surfaces are separable from each other to provide a space therebetween allowing an aqueous test sample to flow.

Embodiment 19 is the article of any one of embodiments 16-18, wherein at least one of the posts has a shape of conical post that is tapered away from the first major surface with a draft angle between 1 and 30 degrees.

Embodiment 20 is the article of any one of embodiments 16-19, wherein the posts have an average aspect ratio between 1:2 and 6:1.

Embodiment 21 is the article of any one of embodiments 16-20, wherein the second major surface of the compartment portion is hydrophobic.

Embodiment 22 is the article of any one of embodiments 16-21, wherein the wells have an average volume of 1 to 500 nanoliters.

Embodiment 23 is the article of any one of embodiments 16-22, wherein the array of posts has a pin density between 100 and 10,000 pins/inch (ppi).

Embodiment 24 is the article of any one of embodiments 16-23, wherein disposable portion comprises one or more of olefin polymer including polypropylene, polyethylene and copolymer, silicone polymer, polyurethane, polyvinyl chloride, ethylene-vinyl acetate polymer, (meth)acrylic polymer, polyamide, polyester, poly(styrene-acrylonitrile), and poly (acrylonitrile-butadiene-styrene).

Embodiment 25 is the article of any one of embodiments 16-24, wherein the compartment portion comprises one or more of (meth)acrylic polymer, polyvinyl acetal resin, polyvinylchloride, polyurethane, silicone polymer, styrenic polymer, vinyl ether polymer, vinylpyrrolidone polymer, polyester including lactone-based polymer, cyclic ether-based polymer including epoxy resin, and ring-opening metathesis polymer.

Embodiment 26 is the article of any one of embodiments 16-25, wherein at least one of the disposable and compartment portions comprises polydimethylsiloxane (PDMS).

Embodiment 27 is the article of any one of embodiments 16-26, wherein at least one of the disposable and compartment comprises a cured acrylate polymer.

Embodiment 28 is the article of any one of embodiments 16-27, further comprising an adhesive layer attached to a surface of the compartment portion opposite the second major surface thereof.

Embodiment 29 is the article of any one of embodiments 16-28, further comprising a tab attached to the disposable portion.

Embodiment 30 is the article of any one of embodiments 16-29, further comprising a cover film that is configured to laminate over the wells on the second major surface of the compartment portion after the wells are filled with the aqueous test sample.

Embodiment 31 is a method comprising:

providing a first film comprising an array of discrete stems each extending away from a first major surface thereof;

providing a second film comprising an array of wells that are mated with the stems of the first film;

submerging the mated stems and wells in an aqueous test sample;

separating the first film from the second film to remove the stems from the wells; and during the removal of the stems, creating one or more voids inside the wells to suction the aqueous test sample into the wells and fill the wells.

Embodiment 32 is the method of embodiment 31, further comprising laminating over the wells on the second major surface of the second film with a cover film after filling the wells.

Embodiment 33 is the method of embodiment 31 or 32, wherein providing the second film comprises applying a film making material to the first major surface of the first film to form the wells mated with the stems.

Embodiment 34 is the method of embodiment 33, wherein the film making material comprises a curable polymeric material that is applied in a viscous or fluid state, and the method further comprises curing or drying the film making material.

Embodiment 35 is the method of any one of embodiments 31-34, wherein the first film comprises one or more of olefin polymer including polypropylene, polyethylene and copolymer, silicone polymer, polyurethane, polyvinyl chloride, ethylene-vinyl acetate polymer, (meth)acrylic polymer, polyamide, polyester, poly(styrene-acrylonitrile), and poly (acrylonitrile-butadiene-styrene).

Embodiment 36 is the method of any one of embodiments 31-35, wherein the second film comprises one or more of (meth)acrylic polymer, polyvinyl acetal resin, polyvinylchloride, polyurethane, silicone polymer, styrenic polymer, vinyl ether polymer, vinylpyrrolidone polymer, polyester including lactone-based polymer, cyclic ether-based polymer including epoxy resin, and ring-opening metathesis polymer.

Embodiment 37 is the method of any one of embodiments 31-36, wherein separating the first film from the second film comprises applying a separation force at a peripheral edge of the first film and peeling the first film away from the second film.

Embodiment 38 is the method of any one of embodiments 31-37, further comprising sterilizing the first and second films by gamma irradiation prior to submerging the mated stems and wells in the aqueous test sample.

Embodiment 39 is a method of producing a sample partitioning device, the method comprising:

providing a first film comprising an array of discrete stems each extending away from a first major surface thereof;

applying a polymeric composition on the first major surface of the first film;

curing the polymeric composition to form a continuous second film comprising an array of discrete wells corresponding to the stems in negative relief, wherein the stems and wells are separably mated with an outer surface and an inner surface being in direct physical contact.

Embodiment 40 is the method of embodiment 39, wherein the first film comprises one or more of olefin polymer including polypropylene, polyethylene and copolymer, silicone polymer, polyurethane, polyvinyl chloride, ethylene-vinyl acetate polymer, (meth)acrylic polymer, polyamide, polyester, poly(styrene-acrylonitrile), and poly(acrylonitrile-butadiene-styrene).

Embodiment 41 is the method of embodiment 39 or 40, wherein the second film comprises one or more of (meth) acrylic polymer, polyvinyl acetal resin, polyvinylchloride, polyurethane, silicone polymer, styrenic polymer, vinyl ether polymer, vinylpyrrolidone polymer, polyester including lactone-based polymer, cyclic ether-based polymer including epoxy resin, and ring-opening metathesis polymer.

Embodiment 42 is a sample partitioning device, comprising:

a film comprising an array of discrete wells formed into a major surface thereof, the array of wells having a density between 100 and 10,000 wells/inch$^2$ (wpi), and the wells having an average volume of 1 to 500 nanoliters, and the wells being Tillable to greater than 95% of their volume with an aqueous solution; and a cover film laminated over the major surface of the film to cover the wells, the cover film providing a vapor impermeable seal over each of the wells.

Embodiment 43 is the device of embodiments 42, wherein at least one of the stems has a shape of conical post that is tapered away from the first major surface with a draft angle between 1 and 30 degrees.

Embodiment 44 is the device of embodiment 42 or 43, wherein the stems have an average aspect ratio between 1:2 and 6:1.

Embodiment 45 is the device of any one of embodiments 42-44, wherein the second major surface of the second film is hydrophobic.

Embodiment 46 is the device of any one of embodiments 42-45, wherein the first film comprises one or more of olefin polymer including polypropylene, polyethylene and copolymer, silicone polymer, polyurethane, polyvinyl chloride, ethylene-vinyl acetate polymer, (meth)acrylic polymer, polyamide, polyester, poly(styrene-acrylonitrile), and poly (acrylonitrile-butadiene-styrene).

Embodiment 47 is the device of any one of embodiments 42-46, wherein the second film comprises one or more of (meth)acrylic polymer, polyvinyl acetal resin, polyvinylchloride, polyurethane, silicone polymer, styrenic polymer, vinyl ether polymer, vinylpyrrolidone polymer, polyester including lactone-based polymer, cyclic ether-based polymer including epoxy resin, and ring-opening metathesis polymer.

Embodiment 48 is the device of any one of embodiments 42-47, wherein at least one of the first and second films comprises polydimethylsiloxane (PDMS).

Embodiment 49 is the device of any one of embodiments 42-48, wherein at least one of the first and second films comprises a cured acrylate polymer.

Embodiment 50 is the device of any one of embodiments 42-49, further comprising an adhesive layer attached to a surface of the second film opposite the second major surface thereof.

Embodiment 51 is the device of any one of embodiments 42-50, further comprising a tab attached to the first film.

EXAMPLES

These examples are merely for illustrative purposes only and are not meant to be limiting on the scope of the appended claims.

Example 1

A polypropylene stem film was produced by a molding process. The stem film has a structure similar as the stem film 10 shown in FIG. 1A, and includes an array of conical posts which are 270 microns tall, 100 microns radius at the base, and 85 microns radius at the apex with a generally flat top. A film forming material was applied to the polypropylene stem film to form a stem-well film such as shown in FIG. 1B. The film forming material has a silicone composition that is commercially available from Dow Corning Corporation (Midland, Mich., USA) under the trade designation SYLGARD 184. The silicone composition was cured at room temperature or elevated temperature to from a Polydimethylsiloxane (PDMS) well film that was separably mated with the polypropylene stem film. The formed wells of the well film each have a volume of about 7.27 nanoliters.

Example 2

Figure 4:
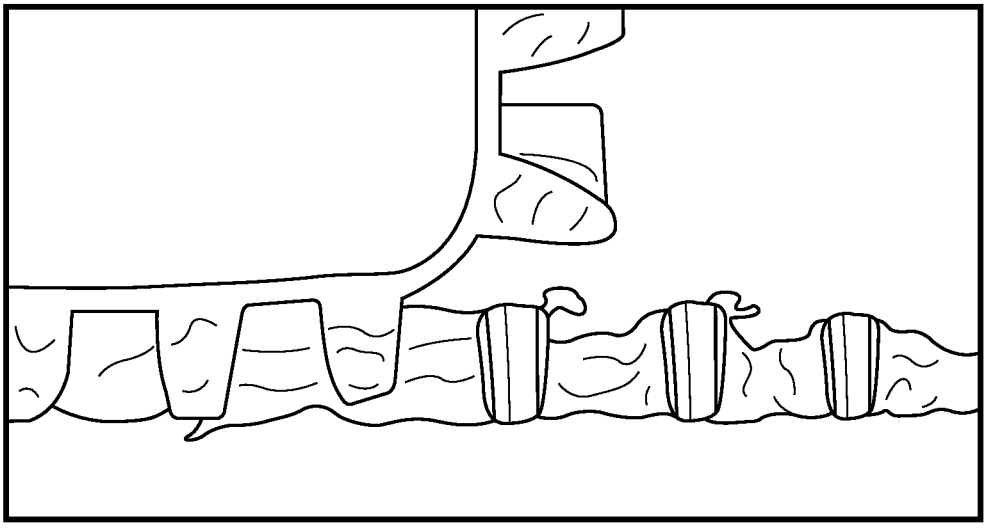
FIG. 4 illustrates an image of an article where a stem film is separating from a mated well film, according to Example 2.

The stem film was the same as in Example 1. The film forming material was prepared as following. Mixtures of 2-Ethylhexyl acrylate (180 grams), isobornyl acrylate (120 grams), Polyvinyl butyral ("PVB") resin (45 grams), hexanediol diacrylate (30 grams), and IRG 651 photoinitiator (0.66 grams) were added to quart jars. The jars and contents were placed in a MAX 20 WHITE SPEEDMIXER (available from FleckTek, Inc., Landrum, S.C.) and mixed at 3500 RPM for 1 minute. The mixture was degassed at −20 inches of mercury (−6.8 kPa) for 5 minutes. Polyvinyl butyral ("PVB") resin is commercially available from Kuraray under the trade designation "Mowital™" and Solutia under the trade designation "Butvar™". IRG 651 photoinitiator is commercially available under the trade name IRGACURE 651 or ESACURE KB-1 photoinitiator (Sartomer Co., West Chester, Pa.). The mixtures were applied to the stem film at a thickness ranging from about 30 to 300 microns and under a nitrogen atmosphere cured by further exposure to UVA light. An image of the separably mated stem-well film was shown in FIG. 4, where the stem film was peeling away from the well film by applying a separation force at a peripheral edge of the stem film.

Liquid Sample Partitioning

A 3 cm by 3 cm piece of the stem-well film of Example 1 or 2 was mounted to the bottom of a 60 mm by 15 mm plastic Petri dish (VWR, Radnor, Pa.) using a double sided acrylate adhesive tape 3M 9969 Transfer Adhesive (3M Company, St. Paul, Minn.) and submerged in Butterfield's buffer (3M Company, St. Paul, Minn.) to which methylene blue (Sigma Aldrich Co., St. Louis, Mo.) had been added to a final concentration of about 1 g/L. Using a metal fine tip tweezers, the stem film was peeled off and discarded while the construction was submerged in the liquid sample. Following removal of the stem film, the remaining liquid sample was decanted and a cover tape was applied. The cover tape had biaxially oriented polypropylene of about 0.05 mm (2 mil) thickness coated with a water-insoluble, silicone based pressure sensitive adhesive, silicone polyurea, of about 0.05 mm (2 mil) thickness. The adhesive was described in U.S. Pat. No. 5,461,134 (Leir et al.) and U.S. Pat. No. 6,007,914 (Joseph et al.). The well film was then placed on the stage of a microscope (Discovery.V8 SteREO, Carl Zeiss Microscopy, Oberkochen, Germany) and the wells were examined to determine the extent of filling using the blue color imparted by the methylene blue dye. Substantially every well in the well film (2232 wells) was completely filled and free of air bubbles either interior to the well or at the well-cover tape interface.

What is claimed is:

1. A sample partitioning device, comprising:

a first film comprising an array of discrete stems each extending from a base to an upper surface thereof, the base being connected to a first major surface of the first film; and a second film comprising an array of discrete wells formed into a second major surface thereof, each well including a sidewall and a bottom, the first major surface of the first film and the second major surface of the second film being in direct physical contact and conformal with each other, and an outer surface of each stem being in direct physical contact and conformal with the sidewall of the respective wells, and the upper surface of each stem being in direct physical contact and conformal with the bottom of the respective wells such that the stems of the first film and the wells of the second film being mated with each other, and at least one of the stems completely filling the respective well, wherein the mated stems and wells are separable from each other, the stems are flexible and have a molecular orientation with a birefringence value of at least 0.001, and during the removal of the stems from the wells, one or more voids are created inside the wells to suction an aqueous test sample into the wells.

2. The device of claim 1, wherein the first major surface of the first film and the second major surface of the second film are in direct physical contact with each other, and the first and second major surfaces are separable from each other to provide a space therebetween allowing the aqueous test sample to flow.

3. The device of claim 1, wherein at least one of the stems has a shape of conical post that is tapered away from the first major surface with a draft angle between 1 and 30 degrees.

4. The device of claim 1, wherein the second major surface of the second film is hydrophobic.

5. The device of claim 1, wherein the wells have an average volume of 1 to 500 nanoliters.

6. The device of claim 1, wherein the array of stems has a density between 100 and 10,000 pins/inch$^2$ (ppi).

7. The device of claim 1, wherein the first film comprises one or more of olefin polymer including polypropylene, polyethylene and copolymer, silicone polymer, polyurethane, polyvinyl chloride, ethylene-vinyl acetate polymer, (meth)acrylic polymer, polyamide, polyester, poly(styrene-acrylonitrile), and poly(acrylonitrile-butadiene-styrene).

8. The device of claim 1, wherein the second film comprises one or more of (meth)acrylic polymer, polyvinyl acetal resin, polyvinylchloride, polyurethane, silicone polymer, styrenic polymer, vinyl ether polymer, vinylpyrrolidone polymer, polyester including lactone-based polymer, cyclic ether-based polymer including epoxy resin, and ring-opening metathesis polymer.

9. The device of claim 1, wherein at least one of the first and second films comprises polydimethylsiloxane (PDMS).

10. The device of claim 1, wherein at least one of the first and second films comprises a cured acrylate polymer.

11. The device of claim 1, further comprising a cover film that is configured to laminate over the wells on the second major surface of the second film after the wells are filled with the aqueous test sample.

12. A method comprising:

providing a first film comprising an array of discrete stems each extending from a base to an upper surface thereof, the base being connected to a first major surface of the first film, wherein the stems are flexible and have a molecular orientation with a birefringence value of at least 0.001;

providing a second film comprising an array of wells that are mated with the stems of the first film, each well including a sidewall and a bottom;

submerging the mated stems and wells in an aqueous test sample;

separating the first film from the second film to remove the stems from the wells; and during the removal of the stems, creating one or more voids inside the wells to suction the aqueous test sample into the wells and fill the wells, wherein the first major surface of the first film and the second major surface of the second film are in direct physical contact and conformal with each other, and an outer surface of each stem is in direct physical contact and conformal with the sidewall of the respective wells, and the upper surface of each stem being in direct physical contact and conformal with the bottom of the respective wells such that the stems of the first film and the wells of the second film being mated with each other, and at least one of the stems completely filling the respective well.

13. The method of claim 12, further comprising laminating over the wells on the second major surface of the second film with a cover film after filling the wells.

14. The method of claim 12, wherein providing the second film comprises applying a film making material to the first major surface of the first film to form the wells mated with the stems.

15. The method of claim 14, wherein the film making material comprises a curable polymeric material that is applied in a viscous or fluid state, and the method further comprises curing or drying the film making material.

16. The method of claim 12, wherein the first film comprises one or more of olefin polymer including polypropylene, polyethylene and copolymer, silicone polymer, polyurethane, polyvinyl chloride, ethylene-vinyl acetate polymer, (meth)acrylic polymer, polyamide, polyester, poly(styrene-acrylonitrile), and poly(acrylonitrile-butadiene-styrene).

17. The method of claim 12, wherein the second film comprises one or more of (meth)acrylic polymer, polyvinyl acetal resin, polyvinylchloride, polyurethane, silicone polymer, styrenic polymer, vinyl ether polymer, vinylpyrrolidone polymer, polyester including lactone-based polymer, cyclic ether-based polymer including epoxy resin, and ring-opening metathesis polymer.

18. The method of claim 12, wherein separating the first film from the second film comprises applying a separation force at a peripheral edge of the first film and peeling the first film away from the second film.

* * * * *